United States Patent [19]

Gabinet

[11] Patent Number: 4,730,859

[45] Date of Patent: Mar. 15, 1988

[54] GOLF BALL RETRIEVER

[76] Inventor: Ronald M. Gabinet, 10251 Ruskin Road, Richmond, British Columbia, Canada, V7A 2P3

[21] Appl. No.: 928,851

[22] Filed: Nov. 7, 1986

[51] Int. Cl.[4] ..... A63B 47/02

[52] U.S. Cl. ..... 294/19.2; 56/400.11

[58] Field of Search ..... 294/19.2, 52, 55, 66.1; 56/400.01, 400.04, 400.05, 400.07, 400.11, 400.13, 400.14; 273/32 F, 162 E

[56] References Cited

U.S. PATENT DOCUMENTS

| | | | |
|---|---|---|---|
| 180,217 | 7/1876 | Ford | 56/400.04 |
| 647,724 | 4/1900 | McCoy | 56/400.13 |
| 691,843 | 1/1902 | Craig | 56/400.11 X |
| 2,270,632 | 1/1942 | Hasty | 294/19.2 |
| 2,738,214 | 3/1956 | Zimmers | 294/19.2 |
| 3,046,044 | 7/1962 | Christle | 294/19.2 |
| 3,169,790 | 2/1965 | Kaanehe | 294/19.2 |
| 3,276,807 | 10/1966 | Ward | 294/19.2 X |
| 3,434,753 | 3/1969 | De Croes | 294/19.2 |
| 3,547,477 | 12/1970 | Young | 294/19.2 |
| 3,614,149 | 10/1971 | Clark | 294/19.2 |
| 3,717,371 | 2/1973 | Halone | 294/19.2 |
| 4,046,413 | 9/1977 | Jeninga | 294/19.2 |
| 4,254,981 | 3/1981 | Wilson | 294/19.2 |
| 4,493,503 | 1/1985 | Jeninga | 294/19.2 |
| 4,635,987 | 1/1987 | Hurtgam | 294/19.2 |

FOREIGN PATENT DOCUMENTS

| | | | |
|---|---|---|---|
| 76300 | 2/1902 | Canada . | |
| 76299 | 4/1902 | Canada . | |
| 88471 | 4/1904 | Canada . | |
| 942347 | 2/1974 | Canada . | |
| 798 | of 1902 | United Kingdom | 294/19.2 |
| 469482 | 7/1937 | United Kingdom | 294/19.2 |

*Primary Examiner*—Johnny D. Cherry

*Attorney, Agent, or Firm*—Marger & Johnson

[57] ABSTRACT

A golf ball retriever for affixation on the end of a handle comprises a rigid elongate member having an upper edge and opposed ends. The upper edge is affixed on the end of the handle, such that the elongate member is centered on the end of the handle with its opposed ends extending perpendicularly to either side of the handle. First and second rigid side members are affixed, respectively, to the opposed ends to project forwardly of the elongate member, beneath and toward the handle when the elongate member is affixed to the handle. A thin, rigid rod extends between the lowermost forward edges of the side members.

10 Claims, 4 Drawing Figures

GOLF BALL RETRIEVER

FIELD OF THE INVENTION

This application pertains to golf ball retrievers for retrieving golf balls from water hazards.

BACKGROUND OF THE INVENTION

The prior art has evolved a variety of devices for retrieving golf balls from water hazards. Typically, such devices comprise an elongated handle with a rake-like head. The head is manipulated under the water with the aid of the handle as the user attempts to draw golf balls which have been lost in the water hazard out of the water. A particular difficulty encountered in using such devices is that the operator is usually not able to see the golf ball which is to be retrieved because the golf ball is immersed in murky water, and/or embedded in silt, and/or obscured by underwater vegetation, etc. It is thus important that the operator be able to detect the presence of a golf ball by tactile sensation when the golf ball retriever makes contact with an underwater golf ball. It is also important that the device, when manipulated by an operator who is unable to see the golf ball, be capable of quickly and accurately entrapping the golf ball so that it may be drawn out of the water. Although a number of prior art golf ball retrievers are likely capable of producing the desired tactile sensation upon contact with an underwater golf ball (i.e. a distinctive feel with is transmitted from the golf ball retriever head along the handle to the operator's hands) the inventor does not consider the prior art devices to be capable of effectively guiding and entrapping the golf ball so as to maximize the likelihood that it may be retrieved from the water. The inventor believes that the prior art devices have been designed with insufficient regard to the ballistics of an underwater golf ball, which differ significantly from those of a golf ball in air.

SUMMARY OF THE INVENTION

In accordance with the invention there is provided a golf ball retriever for affixation on the end of a handle. The golf ball retriever comprises a rigid, elongate member having an upper edge and opposed ends. Means for affixation of the upper edge on the end of the handle are provided, such that the elongate member is centered on the end of the handle, with its opposed ends extending perpendicularly to either side of the handle. First and second rigid side members are affixed, respectively, to the opposed ends to project forwardly of the elongate member, beneath and toward the handle when the elongate member is affixed to the handle. A thin, rigid rod extends between the lowermost forward edges of the side members. Advantageously, the rod is vertically displaced approximately two inches beneath the upper edge of the elongate member and is horizontally displaced approximately one inch forwardly of the elongate member.

Preferably, the side members are plates which cover the ends of the retriever between the rod and the upper edge. The side members are displaced apart for entrapment of up to four golf balls between the side members. The rod extends beneath the lower forward edges of the side members. The elongate member, the side members and the rod provide, respectively, upper rear, side and lower frontal support for a golf ball entrapped by the retriever. The elongate member may advantageously further comprise a lower edge, such that the lower edge, the side members and the rod provide, respectively, upper rear, side and lower frontal support for a golf ball entrapped by the retriever.

A cap member may be disposed between the side members and above the rod to deflect down toward the rod golf balls which are contacted underwater by the rod and deflected upwardly thereby.

The lower portions of the side members are preferably cut away to enable rotation of the retriever relative to a steep underwater embankment with the rod closely proximate the surface of the embankment.

DETAILED DESCRIPTION OF THE PREFERRED EMBODIMENT

Figure 1:
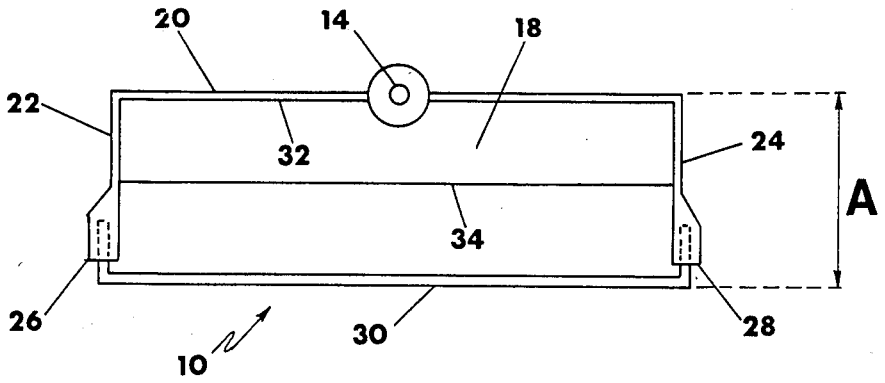
FIG. 1 is a front elevation view of a golf ball retriever according to the invention.

The drawings depict a golf ball retriever 10 which may be affixed on the end of telescopically extendible handle 12 (shown only in FIG. 2) by screwing threaded stud 14 into a mating threaded collar 16 provided in the end of handle 12. Golf ball retriever 10 comprises a rigid, elongate member 18 which may be formed of plastic or other high strength, light weight material. Elongate member 18 has an upper edge 20 (FIG. 1) and a pair of opposed ends 22, 24. Stud 14 serves as a "means for affixation" of upper edge 20 on the end of handle 12, such that elongate member 18 is centered on the end of handle 12 with opposed ends 22, 24 extending perpendicularly to either side of handle 12.

Figure 2:
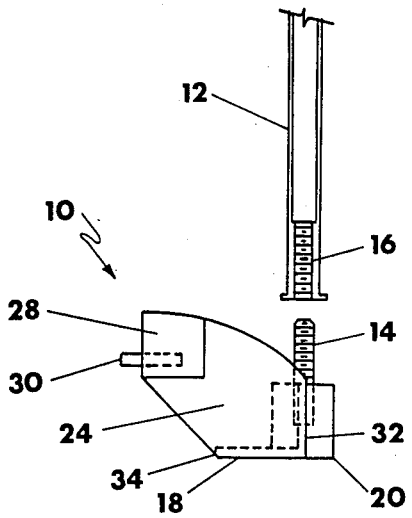
FIG. 2 is a side elevation view of a golf ball retriever according to the invention; and, FIG. 3 is a bottom view of a golf ball retriever according to the invention.

A pair of first and second rigid side members, namely, plates 26, 28,are affixed, respectively, to each of opposed ends 22, 24 to project forwardly of elongate member 18, beneath and toward handle 12 when elongate member 18 is affixed to handle 12 (as best seen in FIG. 2).

A thin, rigid steel rod 30 extends between the lowermost forward edges of side members 26, 28. The ends of rod 30 may be bent at right angles and inserted into apertures provided in the flared ends of plates 26, 28 as shown in the drawings. Plates 26, 28 cover the opposed ends of retriever 10 between upper edge 20 and rod 30.

Rod 30 is preferably vertically displaced a distance "A" (FIG. 1) of approximately two inches beneath upper edge 20. Rod 30 is further preferably horizontally displaced a distance "B" (FIG. 3) of approximately one inch forwardly of elongate member 18.

An examination of the drawings will reveal that rod 30 extends beneath the lower forward edges of plates 26, 28. This is to ensure that rod 30 is at the lowest point of golf ball retriever 10, when the device is positioned underwater for retrieving golf balls, so that rod 30 will be able to pass under golf balls which it contacts.

The inventor has found that a distinctive "feel" or tactile sensation is produced and transmitted along handle 12 when rod 30 contacts an underwater golf ball. When such contact is made, the operator may draw handle 12 shortly and sharply toward himself to "nudge" rod 30 underneath the golf ball. This causes the golf ball to "skip" up over rod 30. The inventor has found that the ballistics of underwater golf balls are such that the golf ball tends to "float" upwardly above rod 30 a considerably greater distance than would be expected if the same action were repeated out of the water. For this reason, the inventor has taken care to ensure that no members extend across the upper frontal region of golf ball retriever 10, because such members (which are typically provided in prior art devices for the apparent purpose of framing an aperture through which golf balls are to be guided for entrapment) might contact the golf ball as it "floats" upwardly over rod 30 and actually deflect the golf ball away from the device, thus preventing retrieval of the golf ball. By contrast, golf ball retriever 10 is completely open along its upper frontal region.

The portions of plates 26, 28 to the rear of rod 30 are cut away at a reasonably steep angle (about 45°) relative to the plane of elongate member 18. This is to eliminate the lower rear corners of plates 26, 28 which could interfere with rotation of retriever 10 as it is held against an underwater surface. For example, as the operator uses handle 12 to draw retriever 10 up the side of a steep underwater embankment, handle 12 must be swung from a more or less horizontal position in which the free end of handle 12 extends alongside of and behind the operator, into a more or less vertical position in which the operator holds the free end of handle 12 upright in front of him. The aforesaid cutaway of plates 26, 28 enables retriever 10 to be rotated closely against the surface of the underwater embankment without causing rod 30 to be lifted clear of the embankment, such that rod 30 remains in optimal position, closely proximate the surface of the underwater embankment, for passage underneath any golf balls which may be encountered along the embankment.

Figure 3:
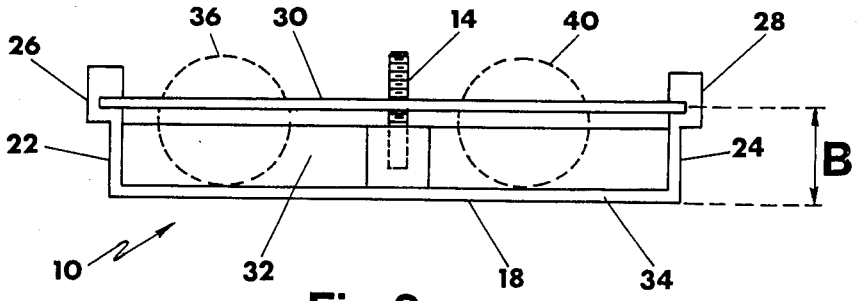
Figure 4:
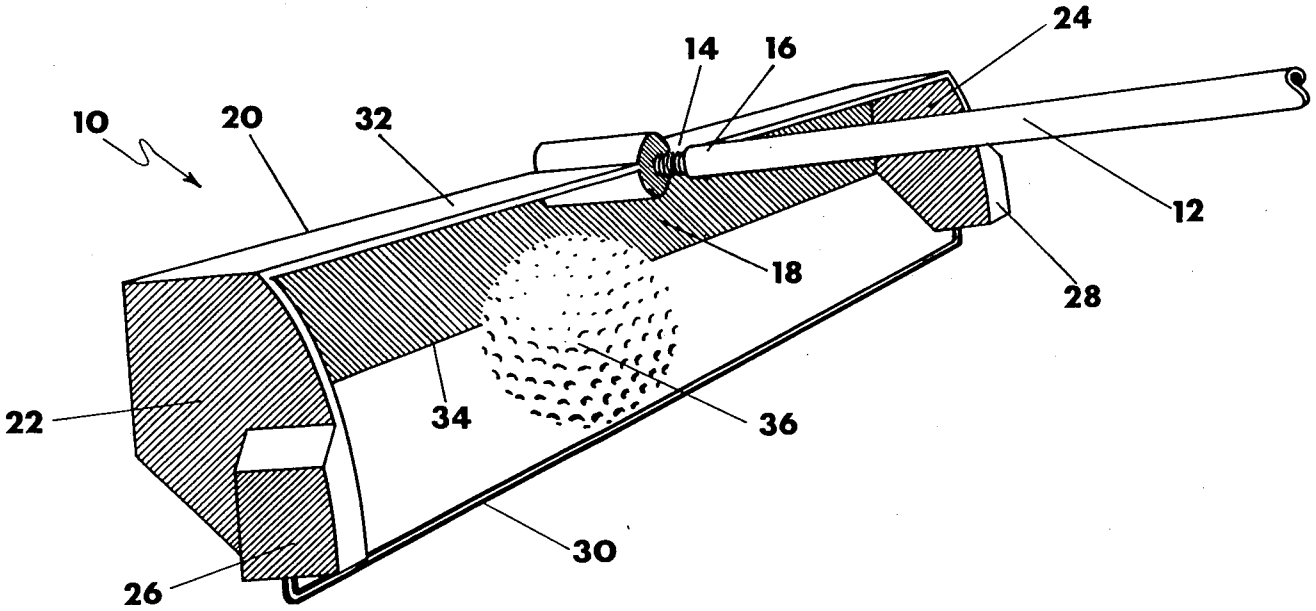
FIG. 4 is a pictorial view of a golf ball retriever according to the invention.

The lower edge 34 of elongate member 18, plates 26, 28 and rod 30 provide, respectively, upper rear, side and lower frontal support for golf balls 36 or 40 entrapped by retriever 10 (FIG. 3). The inventor has found such support to be entirely adequate for golf ball retrieval purposes. Plates 26, 28 are displaced apart for entrapment of up to four golf balls between side members 26, 28. This displacement also gives retiever 10 sufficient width to enable the operator to cover a reasonably wide underwater swath along which golf balls may be located.

Golf ball retriever 10 further comprises a cap member 32 which is disposed between plates 26, 28 and above rod 30 in order to deflect downwardly toward rod 30 golf balls which are contacted underwater by rod 30 and thereby caused to "skip" up over rod 30 as described above. It will however be noted that cap 32 extends across the rear portion of retriever 10, (i.e. cap 32 is disposed toward the rear edges of plates 26, 28) so as not to obstruct the upper frontal region previously described.

As will be apparent to those skilled in the art in light of the foregoing disclosure, many alterations and modifications are possible in the practice of this invention without departing from the spirit and scope thereof. Accordingly, the scope of the invention is to be construed in accordance with the substance defined by the following claims.

I claim:

1. A golf ball retriever for affixation on the end of a handle, said golf ball retriever comprising:

(a) a rigid, elongate member having an upper edge and opposed ends;

(b) means for affixation of said upper edge on the end of said handle, such that said member is centered on the end of said handle with said opposed ends extending perpendicularly to either side of said handle;

(c) first and second rigid side members affixed, respectively, to said opposed ends to project forwardly of said elongate member, beneath and toward said handle when said elongate member is affixed to said handle;

(d) a thin rigid rod extending between the lowermost forward edges of said side members; and, (e) a cap member disposed between said side members and above said rod to deflect toward said rod golf balls contacted underwater by said rod and deflected upwardly thereby; and wherein said cap member is disposed toward the rear edges of said side members.

2. A golf ball retriever for affixation on the end of a handle, said golf ball retriever comprising:

(a) a rigid, elongate member having an upper edge and opposed ends;

(b) means for affixation of said upper edge on the end of said handle, such that said member is centered on the end of said handle with said opposed ends extending perpendicularly to either side of said handle;

(c) first and second rigid side members affixed, respectively, to said opposed ends to project forwardly of said elongate member, beneath and toward said handle when said elongate member is affixed to said handle; and, (d) a thin rigid rod extending between the lowermost forward edges of said side members wherein the lower rear portions of said side members are cut away to enable rotation of said retriever relative to a steep underwater embankment with said rod closely proximate the surface of said embankment.

3. A golf ball retriever as defined in claim 1 or 2, wherein said rod is vertically displaced approximately two inches beneath said upper edge.

4. A golf ball retriever as defined in claim 3, wherein said rod is horizontally displaced approximately one inch forwardly of said elongate member.

5. A golf ball retriever as defined in claim 1 or 2, wherein said side members are plates which cover the ends of said retriever between said rod and said upper edge.

6. A golf ball retriever as defined in claim 1 or 2 wherein said rod extends beneath the lower forward edges of said side members.

7. A golf ball retriever as defined in claim 1 or 2 wherein said elongate member, said side members and said rod provide, respectively, upper rear, side and lower frontal support for a golf ball entrapped by said retriever.

8. A golf ball retriever as defined in claim 1 or 2 wherein said side members are displaced apart for entrapment of up to four golf balls between said side members.

9. A golf ball retriever as defined in claim 1 or 2 wherein said elongate member further comprises a lower edge, and wherein said lower edge, said side members and said rod provide, respectively, upper rear, side and lower frontal support for a golf ball entrapped by said retriever.

10. A golf ball retriever as defined in claim 1 or 2 further comprising a cap member disposed between said side members and above said rod to deflect toward said rod golf balls contacted underwater by said rod and deflected upwardly thereby.

* * * * *